US005480106A

United States Patent [19]

Voissem

[11] Patent Number: 5,480,106

[45] Date of Patent: Jan. 2, 1996

[54] CORE PLUG FOR STEEL COILS WITH VARIABLE LENGTH BRIDGE

[75] Inventor: Ted J. Voissem, Appleton, Wis.

[73] Assignee: Badger Plug Company, Appleton, Wis.

[21] Appl. No.: 272,186

[22] Filed: Jul. 8, 1994

[51] Int. Cl.[6] ..... B65H 75/24

[52] U.S. Cl. ..... 242/571; 242/613.5

[58] Field of Search ..... 242/571, 606, 242/609.1, 610.1, 610.2, 610.3, 610.5, 613.4, 613.5

[56] References Cited

U.S. PATENT DOCUMENTS

| | | | |
|---|---|---|---|
| 726,147 | 4/1903 | Dodge . | |
| 1,591,771 | 7/1926 | Batchelor | 242/571 |
| 1,916,822 | 7/1933 | Bochmann . | |
| 2,499,890 | 3/1950 | Themak . | |
| 2,535,693 | 12/1950 | Murray . | |
| 2,695,139 | 11/1954 | Horvath . | |
| 2,721,042 | 10/1955 | Betz | 242/571 |
| 2,924,395 | 2/1960 | Steele | 242/609.1 |
| 2,966,259 | 12/1960 | Rauscher | 242/609.1 X |
| 3,203,453 | 8/1965 | McConnell . | |
| 3,411,733 | 11/1968 | Lawon et al. . | |
| 3,952,963 | 4/1976 | Ueno et al. | 242/610.1 |

FOREIGN PATENT DOCUMENTS

| | | |
|---|---|---|
| 516053 | 12/1939 | United Kingdom . |

*Primary Examiner*—John M. Jillions
*Attorney, Agent, or Firm*—Wheeler & Kromholz

[57] ABSTRACT

A core plug to be placed within a steel coil is provided with a gap in its circumference and a bridge selected to be of a length to span the gap resiliently with its end held in fixed positions in the core plug so that the core plug may be installed within a steel coil with the bridge bowed inwardly after which the bridge may be snapped over center to bow outwardly and hold the core plug snugly within the steel coil.

5 Claims, 1 Drawing Sheet

CORE PLUG FOR STEEL COILS WITH VARIABLE LENGTH BRIDGE

BACKGROUND OF THE INVENTION

Core plugs for steel coils have traditionally been made with a cylindrical portion to fit the inside of the coil and a radial flange to abut the end of the coil so that the coil may be lifted and supported on the core plug for handling. However steel coils are not entirely uniform in their inner diameter. For that reason a core plug of fixed diameter may need to be wedged into an inner diameter that is too small or otherwise secured to a steel coil having an inner diameter that is too large, or the core plug may simply be too loose.

This invention remedies these problems by forming the cylindrical core plug with a short gap which is bridged by means of a separate piece having locking ends. By providing separate pieces of different lengths, the split core plug may be expanded to whatever diameter is needed to snugly fit into a steel coil, greatly simplifying handling.

One of the objects of this invention is to provide a core plug for a steel coil that fits a wide tolerance of inner coil diameters. Another object is to provide a core plug that is easy to install and easy to remove. Another object is to provide a core plug that can be used in a variety of different size inner diameters of steel coils by simply changing one part. Yet a further object is to provide a core plug that is durable and can be re-used or recycled. These and other objects of my invention will become evident in the following descriptions.

SUMMARY OF THE INVENTION

The invention consists of a core plug having at least one gap in the circumference of the core plug extending axially entirely through the plug so that the diameter of the plug may be changed. The plug is provided with an opening on each side of the gap to receive the end of a bridge. The bridge is provided at each end with a notched portion capable of going through the opening in the core plug and a wider portion which is not capable of going through the opening so that when the two ends of the bridge are installed in the openings in the core plug the wider portion of the bridge biases the ends of the core plug adjoining the gap outwardly to fit snugly within a steel coil. At the same time the inner diameter of the steel coil captures the ends of the bridge and holds them firmly in place.

In its preferred form the openings in the core plug at each side of the gap in its circumference are keyhole-shaped with a wider portion that is more remote from the gap and a narrow linear portion that is closer to the gap. Each end of the bridge is provided with a T-shaped portion designed to enter the opening while the arm of the T is aligned with the narrow portion of the slot. When both ends of the bridge are in their respective key-shaped slots the bridge is rotated 90 degrees on its long axis to bring the crossbar of the T-shaped end of the bridge behind the key-shaped slot and allowing it to extend further in an axial direction than the width of the key-shaped slot so that it is no longer possible for the ends of the bridge to pass through the key-shaped slot in that position. Likewise the shoulders of the end of the bridge where the T-shaped portion adjoins the wider main body of the bridge extend axially beyond the margins of the key-shaped slot on the inside, so that the bridge becomes a resilient member resisting closure of the gap between the ends of the cylindrical core plug.

The bridge may be pulled inwardly as the core plug is inserted into the inner diameter of the steel coil to allow the ends of the gap to approach each other but when the core plug is within the steel coil the bridge is allowed to relax. The bridge is then pushed outwardly toward the inner diameter of the steel coil, snapping the bridge from its inwardly bowed position to an outwardly bowed position in which the core plug is confined by the steel coil on the outside and is resiliently urged outwardly by the bridge on the inside.

DETAILED DESCRIPTION

Figure 1:
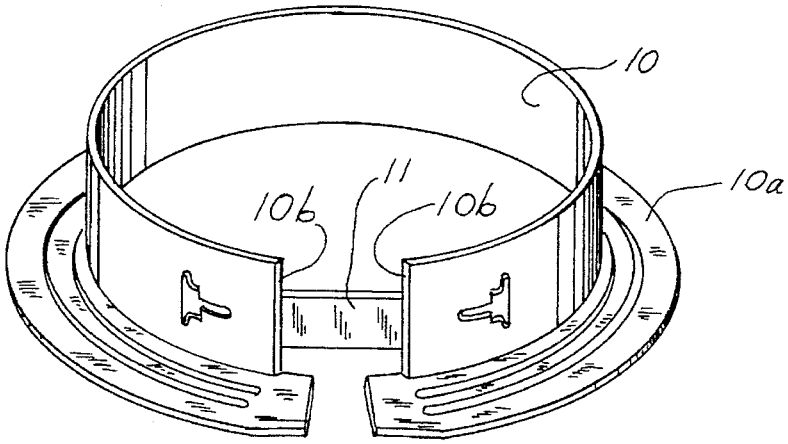
FIG. 1 is a top perspective view of the core plug of my invention.
Figure 2:
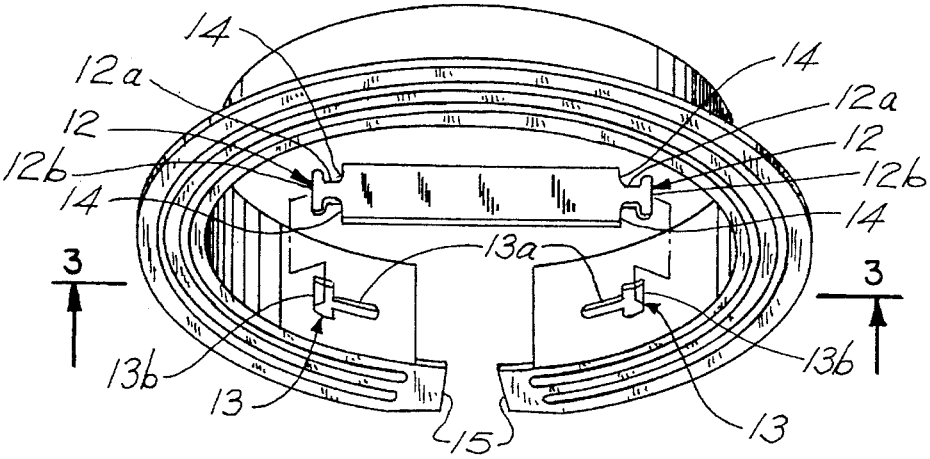
FIG. 2 is a bottom perspective expanded view with the bridge portion shown with lines showing its installation into the main body of the core plug.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The core plug of my invention comprises a cylindrical main body 10 having a radial flange 10*a* and ends 10*b* defining a gap in the cylindrical main body 10 across which a bridge 11 may be installed. The bridge 11 is provided with a T-shaped end 12 at each end. T-shaped end extension 12 has a narrow neck 12*a* which forms the upright bar of the T and a cross-bar 12*b* forming the horizontal bar of the T. Shoulders 14 form the end of the main portion of bridge 11.

The main body of cylindrical core plug 10 is provided with a key-shaped slot 13 at either side of the gap formed by ends 10*b*. Each key-shaped slot 13 has a narrow linear portion 13*a* closest to the gap and a broader rectangular section 13*b* most remote from the gap.

Each T-shaped end 12 of bridge 11 may be placed into slot 13 by aligning bridge 11 with the cross-bar 12*a* of the T-shaped end extension 12 of bridge 11 with narrow portion 13*a* of key-shaped slot 13 so that the width of the cross-bar 12*b* of T-shaped extension 12 passes readily through slot 13. When both T-shaped ends 12 of bridge 11 have passed through slots 13 bridge 11 is rotated 90 degrees about its long axis. The dimensions of the cross-bar 12*b* of the T-shaped extension 12 of bridge 11 is greater than the width of the rectangular portion 13*b* of slot 13 so that after rotation of bridge 11 the T-shaped extensions 12 of bridge 11 can no longer pass through slot 13. Likewise the width of the main body of bridge 1i is wider than slot 13 so that shoulders 14 at the ends of bridge 11 and at the base of the T-shaped extensions 12 bear against the inner margin of cylindrical body 10 of the core plug.

The length of the bridge 11 between shoulders 14 serves to determine the diameter of core plug 10. By selecting a bridge 11 of the proper length, the diameter of the core plug 10 can be adjusted to fit within a variety of steel coils 20. If the length of bridge 11 has been properly selected, after the bridge has been installed in cylindrical body 10 the cylindrical body 10 may be inserted within the inner diameter of the steel coil 20 by pulling inwardly on bridge 11 to contract the gap formed by ends 10*b* slightly. Once the core plug 10 has been installed within the inner diameter of steel coil 20 such that radial flange 10*a* rests against the side of steel coil 20, bridge 11 can be snapped over center from the position shown in FIG. 3 to the position shown in FIG. 4 where its own length between shoulders 14 is great enough to resiliently urge the core plug 10 outwardly while preventing bridge 11 from snapping inward spontaneously. Cross-bars 12*b* of the T-shaped extensions 12 of bridge 11 at each end are captured between steel coil 20 and core plug 10 so that the whole arrangement is stable without any additional wedges.

Figure 3:
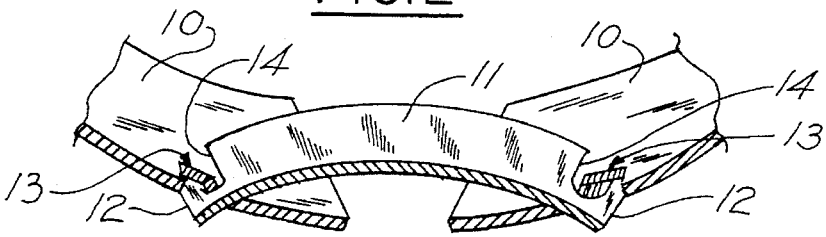
FIG. 3 is a fragmentary cross-sectional view on line 3—3 of FIG. 2.
Figure 4:
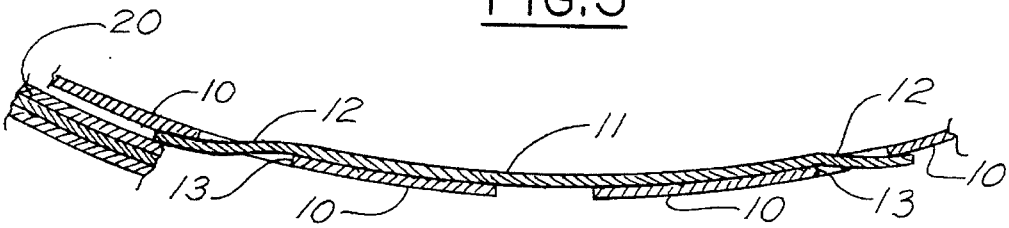
FIG. 4 is a view similar to FIG. 3 but with the core plug installed in a steel coil and with the bridge portion of the core plug snapped outwardly.

At the same time, when ever it is desired to remove core plug 10 from steel coil 20 it is only necessary to pull inwardly on bridge 11 causing it to snap over center again so that it is bowed inwardly as in FIG. 3, allowing the diameter of core plug 10 to be reduced by bringing the ends 10*b* toward each other for ready removal from steel coil 20.

The core plug 10 and bridge 11 are preferably manufactured from plastic. Both components are designed to be reused. It is intended for the metal fabricator to send core plugs 10 and bridges 11 back to the steel mill or steel slitter after the steel coil has been used. Furthermore, damaged or worn out core plugs 10 and bridges 11 can be recycled.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A core plug for placement within a steel coil, the core plug comprising:

a cylindrical main body and a radial flange at one end of a cylindrical portion of the cylindrical main body;

said main body having a radial gap extending axially all the way through the main body and through the radial flange;

a bridge adapted to span the gap having ends engageable with the main body;

at least one aperture at each side of the gap adapted to receive each said end of said bridge;

each said bridge end engaged within one of said apertures.

2. The core plug of claim 1 wherein the length of said bridge is selected to be slightly greater than the distance between the apertures of the main body engaged with the ends of the bridge where said main body is within a steel coil.

3. A core plug for placement within a steel coil, the core plug comprising:

a cylindrical main body and a radial flange at one end of a cylindrical portion of the cylindrical main body;

said main body having a radial gap extending axially all the way through the main body;

a bridge adapted to span the gap in the main body having ends engageable with the main body;

engaging means at each side of the gap engaging each said end of said bridge;

the length of said bridge being selected to be slightly greater than the distance between the engaging means engageable with the ends of the bridge when said main body is within a steel coil.

4. The core plug of claim 3 wherein the engaging means engageable with the ends of the bridge is a key-shaped slot.

5. The core plug of claim 4 wherein said bridge has a width wider than said key-shaped slot and shoulders engageable with the inner side of said key-shaped slot;

said bridge further comprising T-shaped end extensions at each end of the bridge dimensioned to pass through said key-shaped slot when said bridge is aligned with the width of the bridge extending radially of said main body;

said T-shaped extensions being wider than said key-shaped slot.

* * * * *